US005816326A

United States Patent [19]

Slater

[11] Patent Number: 5,816,326

[45] Date of Patent: Oct. 6, 1998

[54] UPHOLE DISPOSAL TOOL FOR WATER PRODUCING GAS WELLS

[75] Inventor: John P. Slater, Satanta, Kans.

[73] Assignee: Oxy USA, Inc., Sublette, Kans.

[21] Appl. No.: 805,401

[22] Filed: Feb. 24, 1997

[51] Int. Cl.[6] ..... E21B 43/40

[52] U.S. Cl. ..... 166/369; 166/105.5; 166/242.3; 166/313

[58] Field of Search ..... 166/369, 313, 166/106, 105.5, 265, 242.3

[56] References Cited

U.S. PATENT DOCUMENTS

| | | | |
|---|---|---|---|
| 2,281,801 | 5/1942 | Reynolds et al. | 166/50 |
| 3,170,520 | 2/1965 | Arutunoff | 166/65.1 |
| 3,363,692 | 1/1968 | Bishop | 166/306 |
| 4,296,810 | 10/1981 | Price | 166/265 |
| 4,429,740 | 2/1984 | Malinchak | 166/53 |
| 4,766,957 | 8/1988 | McIntyre | 166/265 |
| 5,176,216 | 1/1993 | Slater et al. | 166/105.5 |
| 5,296,153 | 3/1994 | Peachey | 166/265 |
| 5,425,416 | 6/1995 | Hammeke et al. | 166/105.5 |
| 5,497,832 | 3/1996 | Stuebinger et al. | 166/369 |
| 5,579,838 | 12/1996 | Michael | 166/106 |
| 5,697,448 | 12/1997 | Johnson | 166/369 |
| 5,730,871 | 3/1998 | Kennedy et al. | 166/265 |

*Primary Examiner*—Hoang C. Dang
*Attorney, Agent, or Firm*—Richard D. Fuerle; Anne E. Brookes

[57] ABSTRACT

Disclosed is an apparatus for recovering gas from an underground source of gas and water and for disposing of water from the source into a porous stratum above the source. A casing having perforations at the level of the porous stratum extends from the surface into the source. A first mandrel inside the casing is above the perforations and a second mandrel inside the casing is below the perforations. Each mandrel has a first and a second passageway therethrough. A perforated tube connects the first passageways of the first and second mandrels and a bypass tube connects the second passageways of the first and second mandrels. A first tube extends from the surface to the first passageway of the first mandrel and a second tube extends from the first passageway of the second mandrel into the source. A sucker rod extends from the surface through the inside of the first, perforated, and second tubes into the source. A pump in the source is actuated by the sucker rod for pumping water up the tubes to a level above the perforations. There is a first seal between the sucker rod and the inside of the first tube or the perforated tube above the perforations, normally at the surface, a second seal between the first mandrel and the casing, and a third seal between the second mandrel and the casing.

19 Claims, 3 Drawing Sheets

1
12
18
17
8
16
14
7
15
5
10
20
4
9
2
11
22
2
4
21
6
14
8
7
15
6
16
17
13
18

UPHOLE DISPOSAL TOOL FOR WATER PRODUCING GAS WELLS

BACKGROUND OF THE INVENTION

This invention relates to apparatus for recovering gas from an underground source of gas and water and for disposing of water from the source into a porous stratum above the source without bringing the water to the surface. In particular, it relates to the use of two mandrels to provide a gas bypass around the area in the well where the water is forced into the porous stratum.

In the production of natural gas from subsurface formations, water frequently enters the well bore along with the natural gas. This water must be removed from the bottom of the well as its presence reduces the production of the natural gas. Since this water is typically salty, it is undesirable to bring it to the surface because then it must be disposed of in accordance with environmental regulations, which may require trucking it or piping it to a suitable disposal well. If there is a porous stratum in the production well, either above or below the location of the gas, the water can be pumped into the porous stratum without bringing it to the surface, thereby avoiding the environmental problems created when it is brought to the surface.

U.S. Pat. No. 3,363,692, in FIG. 2, describes apparatus for disposing of water in a production well by pumping it into a porous stratum which is above the gas producing formation. While the apparatus described in that patent will conceptionally perform the required functions, in practice it is difficult to implement the apparatus.

SUMMARY OF THE INVENTION

I have discovered an apparatus which will pump water from a water bearing, gas producing formation into a porous stratum that is above that formation. Unlike prior apparatus, the apparatus of this invention is easily assembled and uses off-the-shelf components.

DESCRIPTION OF THE PREFERRED EMBODIMENTS

The apparatus of this invention is useful in those production wells where both water and gas are produced and a porous stratum lies above the production zone. The existence of such a porous stratum can be determined from permeability or porosity studies of the ground, the production history of other wells, or from geological data from the area. To implement the invention, it is necessary to know the depths of the natural gas formation and the porous stratum.

Figure 1A:
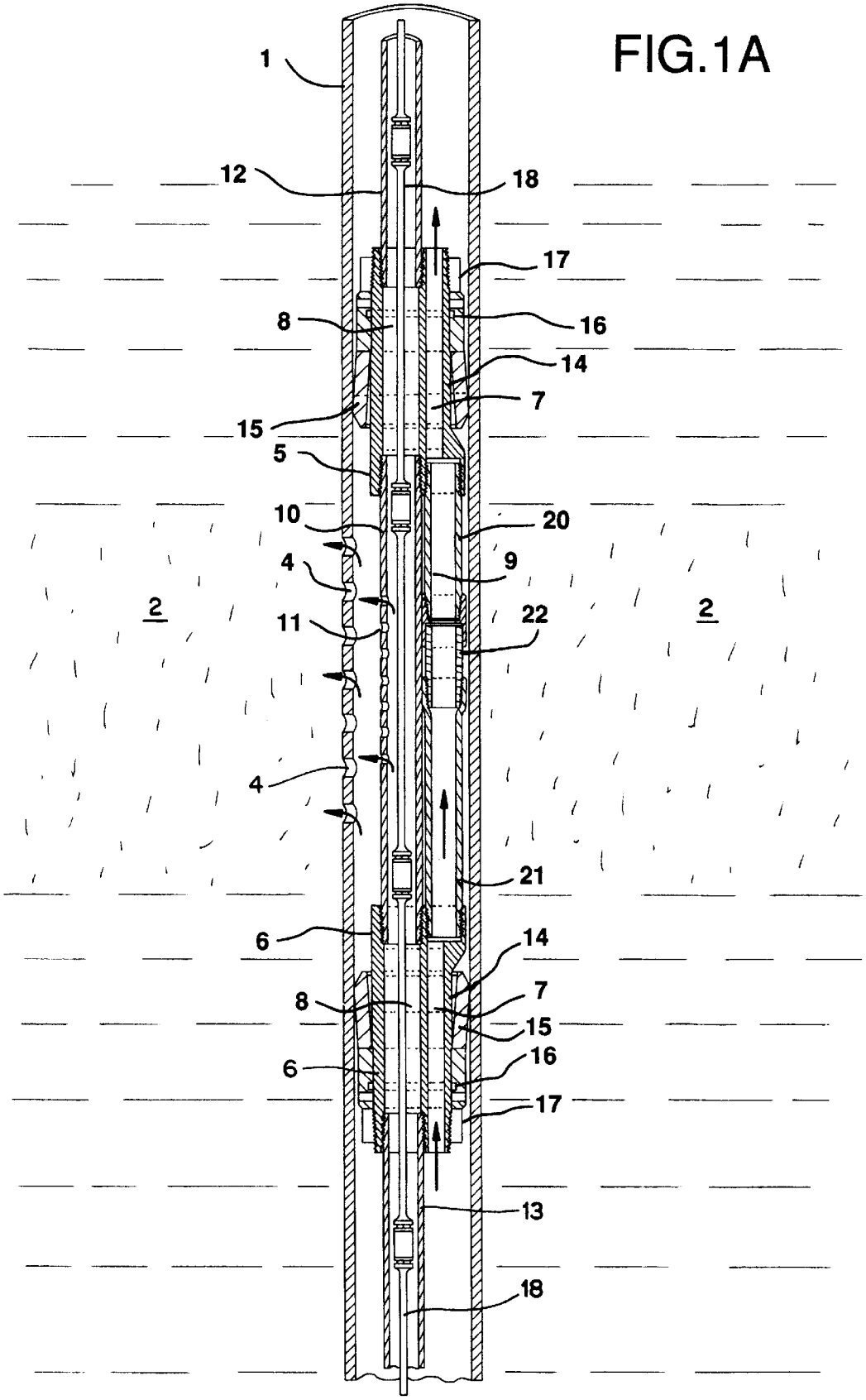
FIGS. 1A and 1B show a side view in section of most of the below ground top and bottom portions, respectively, of the apparatus according to this invention.
Figure 1B:
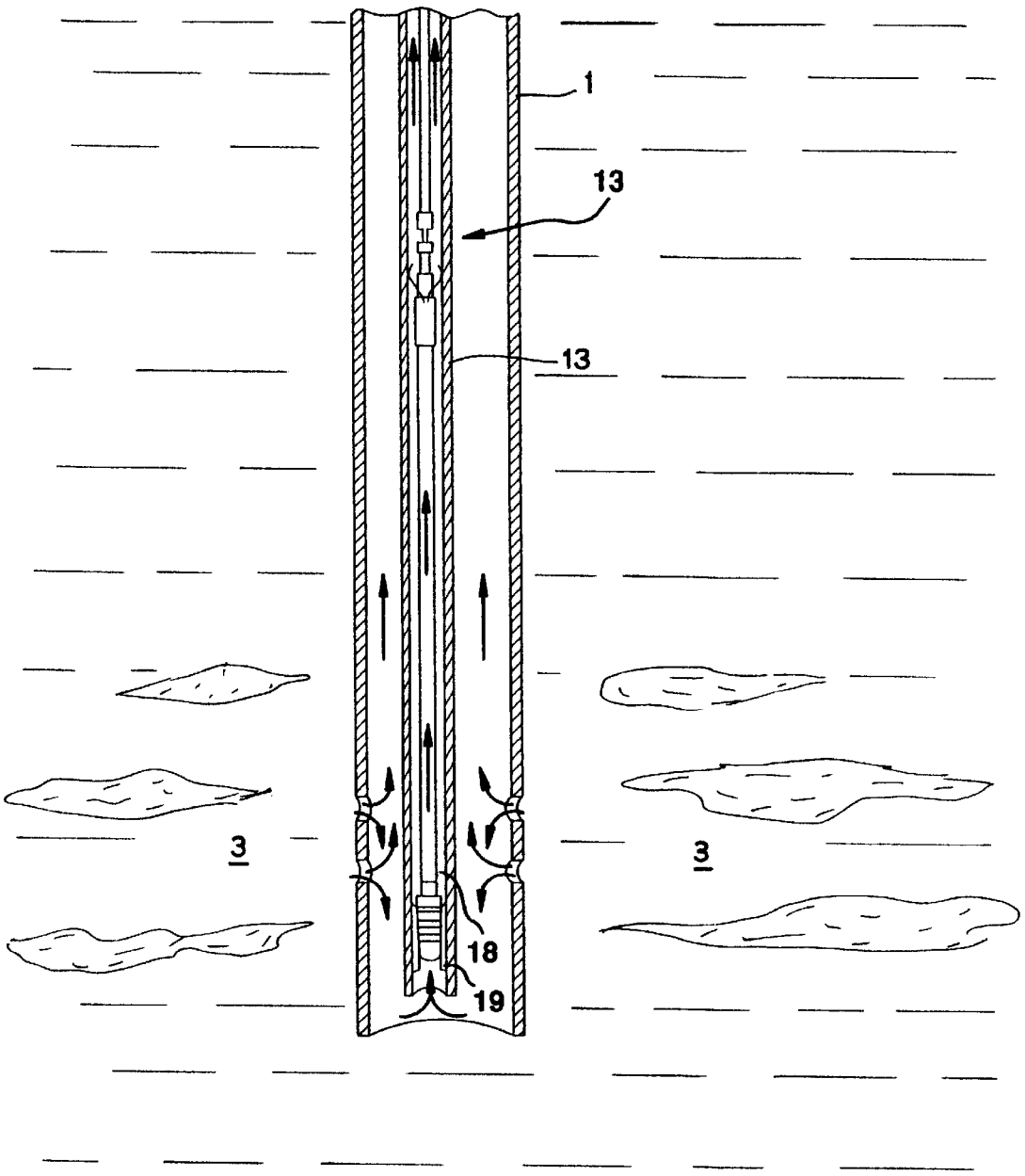
Figure 3:
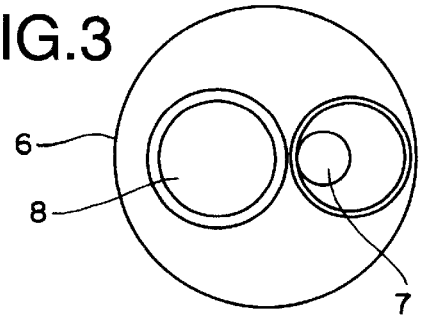
FIG. 3 is a top view of mandrel 6.
Figure 2:
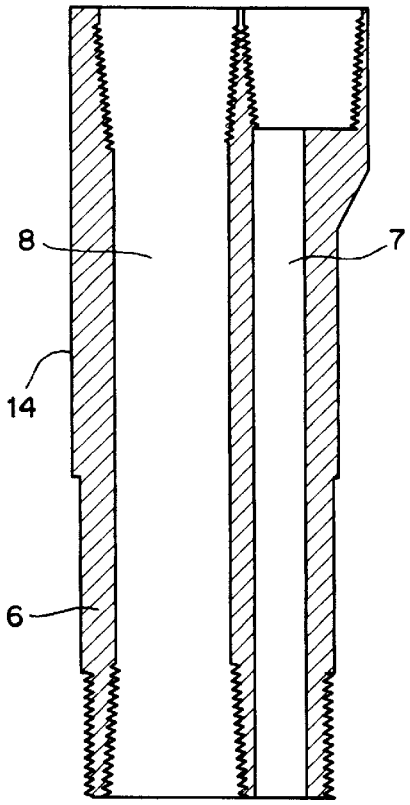
FIG. 2 is a side view in sections of mandrel 6.
Figure 4:
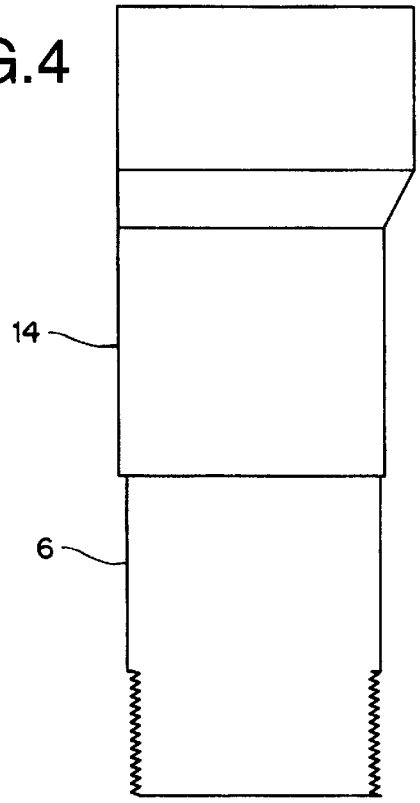
FIG. 4 is a side view of mandrel 6.
Figure 5:
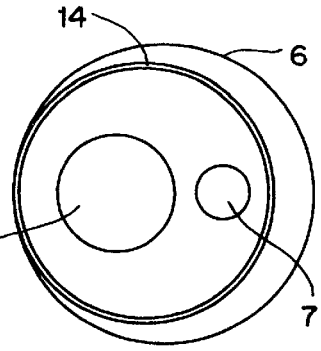
FIG. 5 is a bottom view of mandrel 6.

Referring to FIG. 1A and 1B, a casing 1, typically 5½ inch steel, extends from the surface (not shown) pass a porous stratum 2, and into the production zone of the natural gas formation 3. There are numerous perforations 4 in casing 1 at the depth of porous stratum 2. These perforations 4 can be, for example, about 2 to about 100 circular holes, each having a diameter of about ¼ to about 1 inch.

Referring to FIGS. 2 to 5, inside casing 1 are two identical, but oppositely facing, mandrels 5 and 6. Each mandrel has a gas passageway 7 and a water passageway 8. The gas passageways 7 are connected by bypass tube 9 (FIGS. 1A and 1B). The water passageways 8 are connected by perforated tube 10. The perforations 11 in perforated tube 10 can be, for example, about 2 to about 100 circular holes each about ¼ to about 1 inch in diameter. The outside diameter of perforated tube 10 is preferably about 1 to about 3½ inches less than the inside diameter of casing 1.

A tube 12 connects water passageway 8 in mandrel 5 to the surface and a tube 13 connects water passageway 8 in mandrel 6 to natural gas formation 3. Tubes 10, 12, and 13 are preferably of the same diameter. Each mandrel 5 and 6 has a circular exterior portion 14. Cup seals 15, at these circular exterior portions 14, are fitted with O-rings 16. Cup seals 15 can be made of a rubbery or elastomeric material so that water pressure between mandrels 5 and 6 forces cup seals 15 against the inside of casing 1. The cup seals thereby effectively seal the outside of mandrels 5 and 6 to the inside of casing 1. Collars 17, threaded onto the outside of mandrels 5 and 6, prevent cup seals 15 from coming off the mandrels. A sucker rod 18 extends from the surface through tube 13, mandrel 5, perforated tube 10, mandrel 6, and tube 12, and attaches to pump 19 in natural gas formation 3. Pump 19 is operated by means of sucker rod 18, usually by a reciprocating motion of the sucker rod. Pump 19 forces the water in natural gas formation 3 into the inside of tube 13, mandrel 6, and tube 10, whence it flows through perforations 11 and 4 into porous stratum 2. A seal (not shown) may be placed between sucker rod 18 and tube 12 if the hydrostatic head does not force the water through perforations 11 and 4 and into porous stratum 2.

Gas from natural gas formation 3 rises in between tube 13 and casing 1 into gas passageway 7 in lower mandrel 6, into bypass tube 9, gas passageway 7 in upper mandrel 5, and in between tube 12 and casing 1 to the top of the well, where it is collected. Bypass tube 9 is most conveniently constructed by screwing two connecting pieces, 20 and 21, into mandrels 5 and 6 and using a telescoping swivel sub 22 in the middle to connect those two pieces. This is done after the rest of the apparatus has been assembled.

I claim:

1. Apparatus for recovering gas from an underground source of gas and water and for disposing of water from said source into a porous stratum above said source comprising (A) a casing extending from the surface into said source, said casing having perforations at the level of said porous stratum;

(B) a first mandrel inside said casing above said perforations and a second mandrel inside said casing below said perforations, each mandrel having a first and a second passageway therethrough;

(C) a perforated tube having perforations therethrough, connecting the first passageways of said first and second mandrels;

(D) a bypass tube connecting the second passageways of said first and second mandrels said bypass tube comprising a telescoping swivel sub in between two connecting pieces;

(E) a first tube extending from the surface to said first passageway of said first mandrel;

(F) a second tube extending from the first passageway of said second mandrel into said source;

(G) a sucker rod inside said first tube, said perforated tube, and said second tube, extending from said surface into said source;

(H) a pump in said source actuated by said sucker rod for pumping water up into said second tube and into said perforated tube to a level above said perforations in said perforated tube;

(I) a first seal between said first mandrel and said casing; and (J) a second seal between said second mandrel and said casing.

2. Apparatus according to claim 1 wherein said first tube, said second tube, and said perforated tube have the same diameter.

3. Apparatus according to claim 2 wherein the inside diameter of said casing is about 1 to about 3½ inches greater than the outside diameter of said first tube.

4. Apparatus according to claim 1 wherein said perforations in said perforated tube are at the same level as said perforations in said casing.

5. Apparatus according to claim 1 wherein there are about 2 to about 100 perforations in said perforated tube.

6. Apparatus according to claim 1 wherein there are about 2 to about 100 perforations in said casing.

7. Apparatus according to claim 1 wherein said perforations in said casing are about ¼ to about 1 inch in diameter.

8. Apparatus according to claim 1 wherein said perforations in said perforation tube are about ¼ to about 1 inch in diameter.

9. A method of recovering gas from an underground source of gas and water where a porous stratum lies above said source comprising placing an apparatus according to claim 1 in a bore hole drilled into said source and activating said pump.

10. Apparatus for recovering gas from an underground source of gas and water and for disposing of water from said source into a porous stratum above said source comprising (A) a casing extending from the surface above said underground source into said source, said casing having perforations at the level of said porous stratum;

(B) a first mandrel inside said casing above said perforations an d a second mandrel inside said casing below said perforations, each mandrel having a first and a second passageway therethrough and a circular exterior portion;

(C) a perforated tube having perforations therethrough connecting the first passageways of said first and second mandrels;

(D) a bypass tube connecting the second passageways of said first and second mandrels said bypass tube comprising a telescoping swivel sub in between two connecting pieces;

(E) a first tube extending from the surface to said first passageway of said first mandrel, (F) a second tube extending from the first passageway of said second mandrel into said source;

(G) a sucker rod inside said first tube, said perforated tube, and said second tube, extending from said surface into said source;

(H) a pump in said source actuated by said sucker rod for pumping water up into said second tube and said perforated tube to a level above said perforations in said perforated tube;

(I) a first seal between said sucker rod and said first tube;

(J) a second seal between the circular exterior portion of said first mandrel and said casing; and (K) a third seal between the circular exterior portion of said second mandrel and said casing.

11. Apparatus according to claim 10 wherein said first tube, said second tube, and said perforated tube have the same diameter.

12. Apparatus according to claim 10 wherein the inside diameter of said casing is about 1 to about 3½ inches greater than the outside diameter of said first tube.

13. Apparatus according to claim 10 wherein said perforations in said perforated tube are at the same level as said perforations in said casing.

14. Apparatus according to claim 10 wherein there are about 2 to about 100 perforations in said perforated tube.

15. Apparatus according to claim 10 wherein there are about 2 to about 100 perforations in said casing.

16. Apparatus according to claim 10 wherein said perforations in said casing are about ¼ to about 1 inch in diameter.

17. Apparatus according to claim 10 wherein said perforations in said perforated tube are about ¼ to about 1 inch in diameter.

18. Apparatus according to claim 10 wherein said second mandrel is identical to said first mandrel, but inverted.

19. Apparatus for recovering gas from an underground source of gas and water and for disposing of water from said source into a porous stratum above said source comprising (A) a casing extending from the surface above said underground source into said source, said casing having perforations at the level of said porous stratum;

(B) a first mandrel inside said casing above said perforations and a second identical, but inverted, mandrel inside said casing below said perforations, each mandrel having a first and a second passageway therethrough and a circular exterior portion;

(C) a perforated tube having perforations therethrough connecting the first passageways of said first and second mandrels;

(D) a bypass tube connecting the second passageways of said first and second mandrels, said bypass tube comprising a telescoping swivel sub in between two connecting pieces;

(E) a first tube having the same diameter as said perforated tube, extending from the surface to said first passageway of said first mandrel;

(F) a second tube having the same diameter as said perforated tube, extending from the first passageway of said second mandrel into said source;

(G) a sucker rod inside said first tube, said perforated tube, and said second tube, extending from said surface into said source;

(H) a pump in said source actuated by said sucker rod for pumping water up into said second tube and said perforated tube to a level above said perforations in said perforated tube;

(I) a first seal between said sucker rod and said first tube;

(J) a second seal between the circular exterior portion of said first mandrel and said casing; and (K) a third seal, identical to said second seal, between the circular exterior portion of said second mandrel and said casing.

* * * * *